US007588099B2

(12) United States Patent
Kracik

(10) Patent No.: US 7,588,099 B2
(45) Date of Patent: Sep. 15, 2009

(54) HORIZONTAL DRILLING SYSTEM WITH OSCILLATION CONTROL

(75) Inventor: John Kracik, Springville, CA (US)

(73) Assignee: Varco I/P, Inc., Orange, CA (US)

( * ) Notice: Subject to any disclaimer, the term of this patent is extended or adjusted under 35 U.S.C. 154(b) by 123 days.

(21) Appl. No.: 11/627,162

(22) Filed: Jan. 25, 2007

(65) Prior Publication Data

US 2007/0175662 A1 Aug. 2, 2007

Related U.S. Application Data

(60) Provisional application No. 60/762,698, filed on Jan. 27, 2006.

(51) Int. Cl.
*E21B 44/00* (2006.01)

(52) U.S. Cl. ..... 175/24; 175/27

(58) Field of Classification Search ..... 175/24, 175/27; 166/380, 77.51
See application file for complete search history.

(56) References Cited

U.S. PATENT DOCUMENTS

| | | | | |
|---|---|---|---|---|
| 2,488,107 | A | | 11/1949 | Abegg |
| 2,863,638 | A | | 12/1958 | Thornburg |
| 3,301,334 | A | | 1/1967 | Odgers et al. |
| 3,708,020 | A | | 1/1973 | Adamson |
| 3,747,675 | A | | 7/1973 | Brown |
| 4,100,968 | A | | 7/1978 | Delano |
| 4,190,119 | A | | 2/1980 | Loftis et al. |
| 4,593,773 | A | | 6/1986 | Skeie |
| 4,885,963 | A | * | 12/1989 | Nishikawa ..... 81/57.32 |
| 4,997,042 | A | | 3/1991 | Jordan et al. |
| 5,191,939 | A | | 3/1993 | Stokley |
| 5,294,228 | A | | 3/1994 | Willis et al. |
| 5,297,833 | A | | 3/1994 | Willis et al. |
| 5,584,343 | A | | 12/1996 | Coone |
| 5,735,348 | A | | 4/1998 | Hawkins, III |
| 5,918,673 | A | | 7/1999 | Hawkins et al. |
| 5,971,079 | A | | 10/1999 | Mullins |
| 6,142,545 | A | | 11/2000 | Penman et al. |

(Continued)

FOREIGN PATENT DOCUMENTS

EP 1171683 B1 9/2007

OTHER PUBLICATIONS

Written Opinion and Search report issued on Aug. 27, 2008 in corresponding PCT Application No. PCT/US07/61066, 8pp.

(Continued)

*Primary Examiner*—William P Neuder
(74) *Attorney, Agent, or Firm*—Christie, Parker & Hale, LLP

(57) ABSTRACT

A system and method for controlling drill string frictional forces during horizontal drilling are provided. The system includes a top drive having a motor that transmits a torque to a drill string to rotate the drill string, and an automated controller operably connected to the top drive to send at least one command signal to the top drive to initiate the rotation of the drill string. The controller monitors torque feedback signals, indicating that a torque limit on the drill string is exceeded, and/or a turn feedback signals indicating that the drill string is stalled to control the direction of the torque applied to the drill string when either the torque limit is exceeded or the drill string stalls.

18 Claims, 4 Drawing Sheets

U.S. PATENT DOCUMENTS

| | | | | |
|---|---|---|---|---|
| 6,527,493 | B1 | 3/2003 | Kamphorst et al. | |
| 6,742,596 | B2 * | 6/2004 | Haugen | 166/380 |
| 7,059,427 | B2 | 6/2006 | Power et al. | |
| 7,096,979 | B2 * | 8/2006 | Haci et al. | 175/61 |
| 7,100,698 | B2 * | 9/2006 | Kracik et al. | 166/380 |
| 2003/0066654 | A1 | 4/2003 | Juhasz et al. | |
| 2006/0005962 | A1 | 1/2006 | Juhasz et al. | |

OTHER PUBLICATIONS

Complaint in CV05-0634A; Pleading; Apr. 11, 2005; 8pp.; W. Dist. Louisiana.
Plaintiff's First Amended Complaint in CV05-0634A; Pleading; Oct. 3, 2005; 7pp.; W. Dist. Louisiana; Alexandria, Louisiana.
Order Granting Motion to Transfer in CV05-0634A; Order; Jul. 19, 2006; 2pp.; W. Dist. Louisiana; Alexandria, Louisiana.
Complaint in H-05-2118; Pleading; Jun. 17, 2005; 7pp.; S. Dist. Texas; Houston, Texas.
First Amended Complaint in CV-05-2118; Pleading; Jun. 23, 2005; 6pp.; S. Dist. Texas; Houston, Texas.
Second Amended Complaint in CV-05-2118; Pleading; Sep. 6, 2005; 6pp.; S. Dist. Texas; Houston, Texas.
Stipulated Protective Order in CV-05-2118; Order; Dec. 5, 2005; 12pp.; S. Dist. Texas; Houston, Texas.
Notice of Opposition in EP 1,171,683 B1; Opposition Document filed in EPO; Apr. 1, 2008; 162pp.; European Patent Office; Europe.
Request for Inter Partes Reexamination of USPN 6,938,709; Reexamination Request filed in USPTO; Oct. 4, 2006; 115pp.; United States Patent and Trademark Office; Alexandria, Virginia.
Request for Inter Partes Reexamination of USPN 7,096,977; Reexamination Request filed in USPTO; Sep. 21, 2006; 123pp.; United States Patent and Trademark Office; Alexandria, Virginia.

* cited by examiner

HORIZONTAL DRILLING SYSTEM WITH OSCILLATION CONTROL

CROSS-REFERENCE TO RELATED APPLICATION(S)

This application claims priority to U.S. Provisional Application No. 60/762,698, filed Jan. 27, 2006, the disclosure of which is incorporated herein by reference.

FIELD OF THE INVENTION

This invention relates to a horizontal drilling system having an automated oscillation control system, and more particularly to an oscillation control system that reverses directions when a torque limit is exceeded and/or a drilling motor stalls.

BACKGROUND OF THE INVENTION

A well-known phenomenon in directional drilling is that hole friction dramatically increases if a horizontal drilling segment is required. That is, static friction (drag) occurs between the mud motor, drill collars, and drill pipe, and the casing and/or open hole. This high friction is caused by the drill string bearing against the bottom side of the hole. Increases in frictional forces are also frequently observed when the drill string tool joints are pushed laterally through the hole. This static friction can cause misleading indications of weight on bit, string weight and down-hole torque making automated control of the drilling process difficult, if not impossible.

To reduce this misleading information, a drilling operator will vibrate or wiggle the drill string to cause it to slide within the hole. One way to vibrate the string is to rotate the drill string back and forth, a motion commonly referred to as oscillating the drill string. Oscillating the drill string causes the drill string to momentarily lift up in the hole thereby reducing the lateral friction. However, oscillating the drill string requires relatively rapid reversals of the drill string rotation. According to one method, such an oscillation of the drill string is done manually by the drilling operator using standard operator controls found on many conventional top drive systems. To perform the oscillation, the operator lowers the motor torque limit and rotates the drill string in a clockwise direction at a low RPM until the drill string stalls or winds-up. The direction of rotation is then changed causing the drill string to unwind and then stall or wind-up in the opposite direction. This procedure is repeated by the operator until the frictional forces are reduced.

However, this manual operation relies on the operator's skill and experience to set parameters and operate the controls correctly. Such a process is also relatively slow, and in some cases causes rapid wear on the motor brakes and drive components because of the non-automated nature of the process. Accordingly, a need exists for a horizontal drilling system having an improved and/or automated oscillation control system.

SUMMARY OF THE INVENTION

With the advent of top drive control systems (TDCS), AC motors, and variable frequency drives (VFD) the operator intensive procedure described above can be automated according to the present invention and enhanced to provide more accurate and smooth oscillation control during horizontal drilling with minimal machine wear. Utilizing the TDCS and VFD each unit can be programmed and/or parameterized to perform this function in a smooth and efficient manner. Using the system and method of the present invention, operational parameters can be monitored during operation, drill string stall can be detected, and string direction can be changed in a controlled manner. All of which will minimize drive component wear while enhancing the operation.

In one embodiment, the present invention is a horizontal drilling system that includes a top drive system having a motor that transmits a torque to a drill string to rotate the drill string. An automated controller is operably connected to the top drive to send at least one command signal to the top drive to initiate the rotation of the drill string. The top drive generates either a torque feedback signal indicating that a torque limit on the drill string is exceeded and/or a turn feedback signal indicating that the drill string is stalled. The controller receives the feedback signals and reverses the direction of the torque applied to the drill string when either the torque limit is exceeded or the drill string stalls.

In another embodiment, the top drive is an electric motor. In such an embodiment where the electric motor is a DC motor, the motor controller controls the speed of the electric motor by controlling the voltage applied, and regulates the amount of torque that can be applied by the electric motor by regulating the amount of current supplied to the electric motor.

In yet another embodiment, the electric motor is an AC motor. In such an embodiment, the controller regulates the torque and speed of the AC motor by regulating the frequency of the power supplied to the AC motor.

In still another embodiment, the controller sets the direction of rotation of the electric motor, through an appropriate means, such as a directional switch for reversing the direction of rotation of the electrical motor.

In still yet another embodiment, the torque feedback signal is determined by the electrical current flowing through the electric motor.

In still yet another embodiment, the electric motor may also be mechanically coupled to a turn encoder for monitoring the amount of rotation of the electric motor. In such an embodiment, a rotational feedback signal is generated when the turn indicator detects that the electric motor has ceased to rotate, or has "stalled."

In still yet another embodiment, operational parameters may be input through a control station to set the programming instructions for the controller. In such an embodiment, the operator may input specific operating parameters for the controller to follow during an oscillation procedure, such as a torque limit for both the clockwise and counter-clockwise directions; and/or a rotation speed for both the clockwise and counter-clockwise directions. The torque limit may be the same in both the clockwise and counter-clockwise directions, or the torque limit may be different in the two directions.

In still yet another embodiment, the controller includes a processor having a central processing unit (CPU), a memory cache, and a bus interface. In such an embodiment, the bus interface is operatively coupled via a system bus to a main memory and an input/output (I/O) interface control unit. The I/O interface control unit is operatively coupled via I/O local bus to a storage controller, and an I/O interface for transmission and reception of signals to external devices. The storage controller is operatively coupled to a storage device for storage of the programming instructions.

In still yet another embodiment, the current invention is directed to a drill string oscillation procedure.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

As shown in FIGS. 1-4, embodiments of the present invention are directed to a horizontal drilling system having a controller for controlling an oscillation procedure of a drill string, whereby the drill string is rotated in a back and forth motion. In one embodiment, the oscillation is controlled by reversing the direction of rotation of the drill string each time a torque limit is exceeded and/or when the drilling motor stalls.

Figure 1:
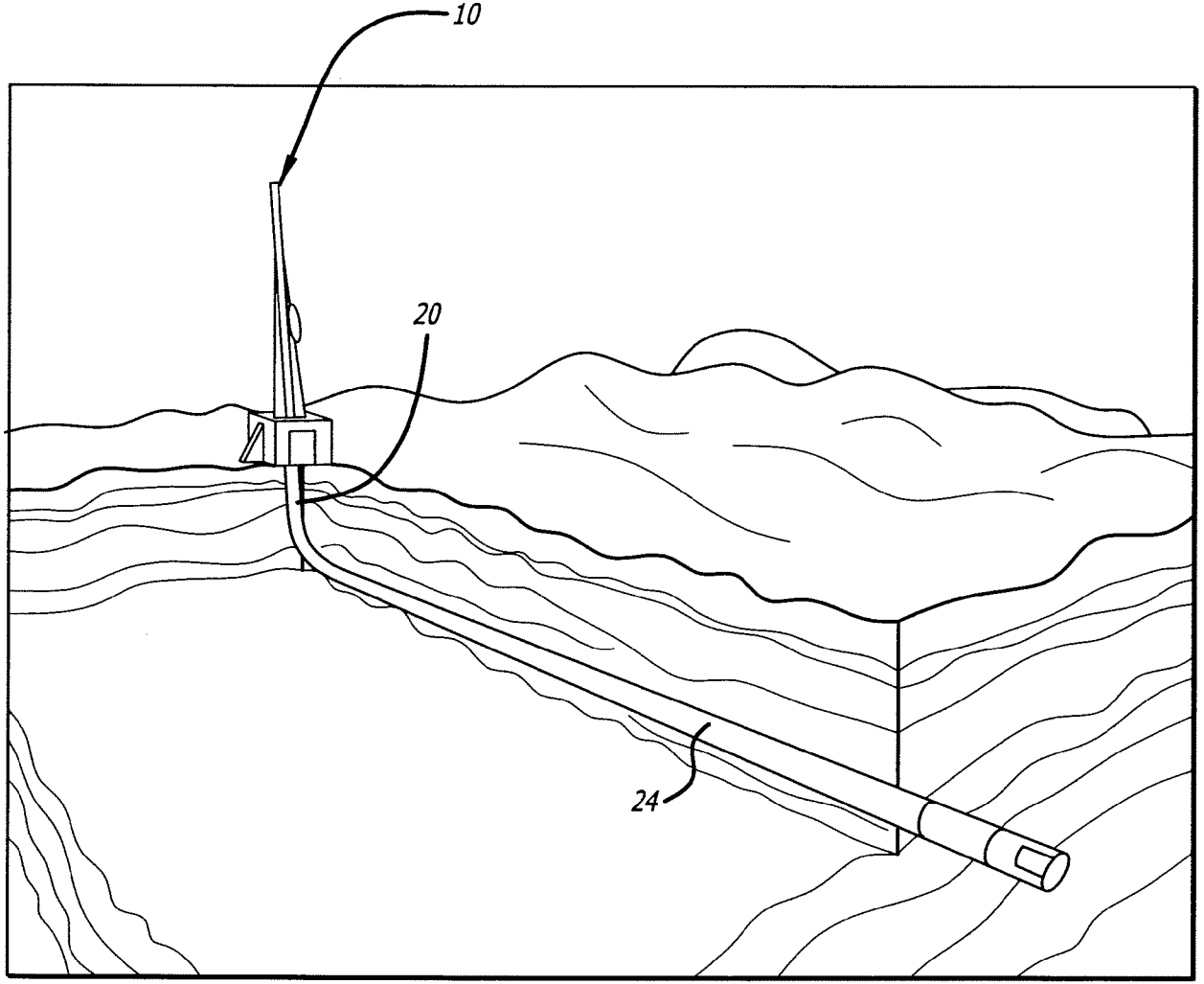
FIG. 1 is a schematic of a horizontal drilling system having a controller for controlling an oscillation procedure of a drill string in accordance with an exemplary embodiment of the present invention.
Figure 2:
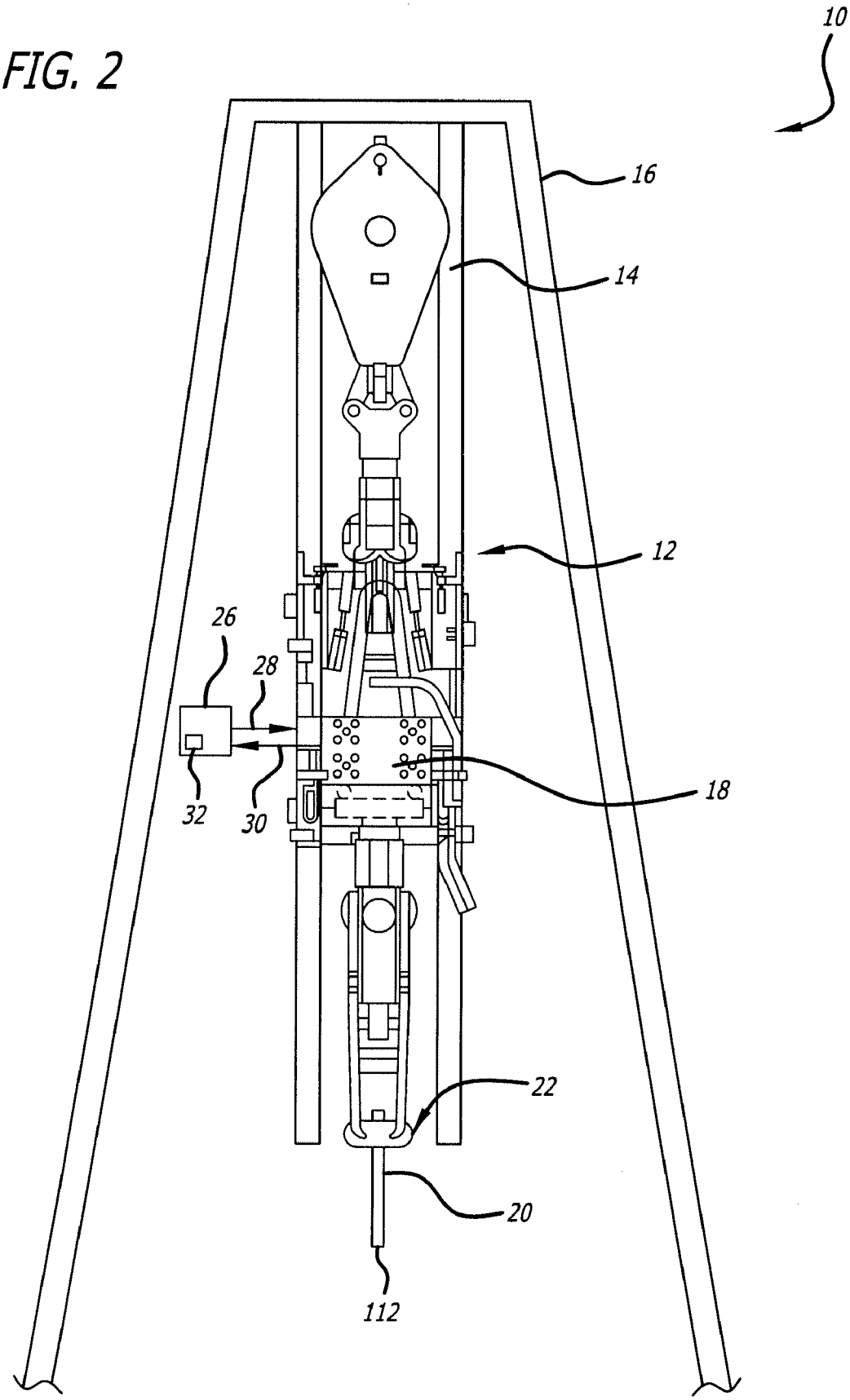
FIG. 2 is a schematic of portions of the horizontal drilling system of FIG. 1, shown enlarged.

FIG. 1 is a schematic view of a horizontal drilling system 10 in accordance with an exemplary embodiment of the present invention. As shown in FIG. 2, the horizontal drilling system 10 includes a top drive system 12. The top drive system 12 is vertically movable along vertical supports 14 of a derrick 16. The top drive system 12 includes a top drive motor 18, which imparts translational and rotational forces to a drill string 20. In one embodiment, the top drive system 12 is connected to a pipe running tool 22, which in turn is connected to the drill string 20 to transfer the translational and rotational forces from the top drive system 12 to the drill string 20. As shown in FIG. 1, the drill string 20 includes a horizontal segment 24 that produces a horizontal hole during a horizontal drilling operation.

As shown schematically in FIG. 2, the top drive system 12 is operably connected to a controller 26. The controller 26 is used to control the top drive system 12 during both the drilling phases and the oscillation phases of a horizontal drilling procedure. As shown in FIG. 2, the top drive system 12 receives command signals 28 from the controller 26 and responds to the command signals 28 by generating a torque and a rotational speed that are applied to the drill string 20.

During operation, the top drive system 12 generates feedback signals 30 that are transmitted to the controller 26. The feedback signals 30 include a torque feed back signal and a rotational feed back signal. The controller 26 uses the feedback signals 30 to monitor the operation of the top drive system 12 during both drilling and oscillation procedures. The functions of the controller 26 are specified by a set of programming instructions 32 located in the controller 26.

Figure 3:
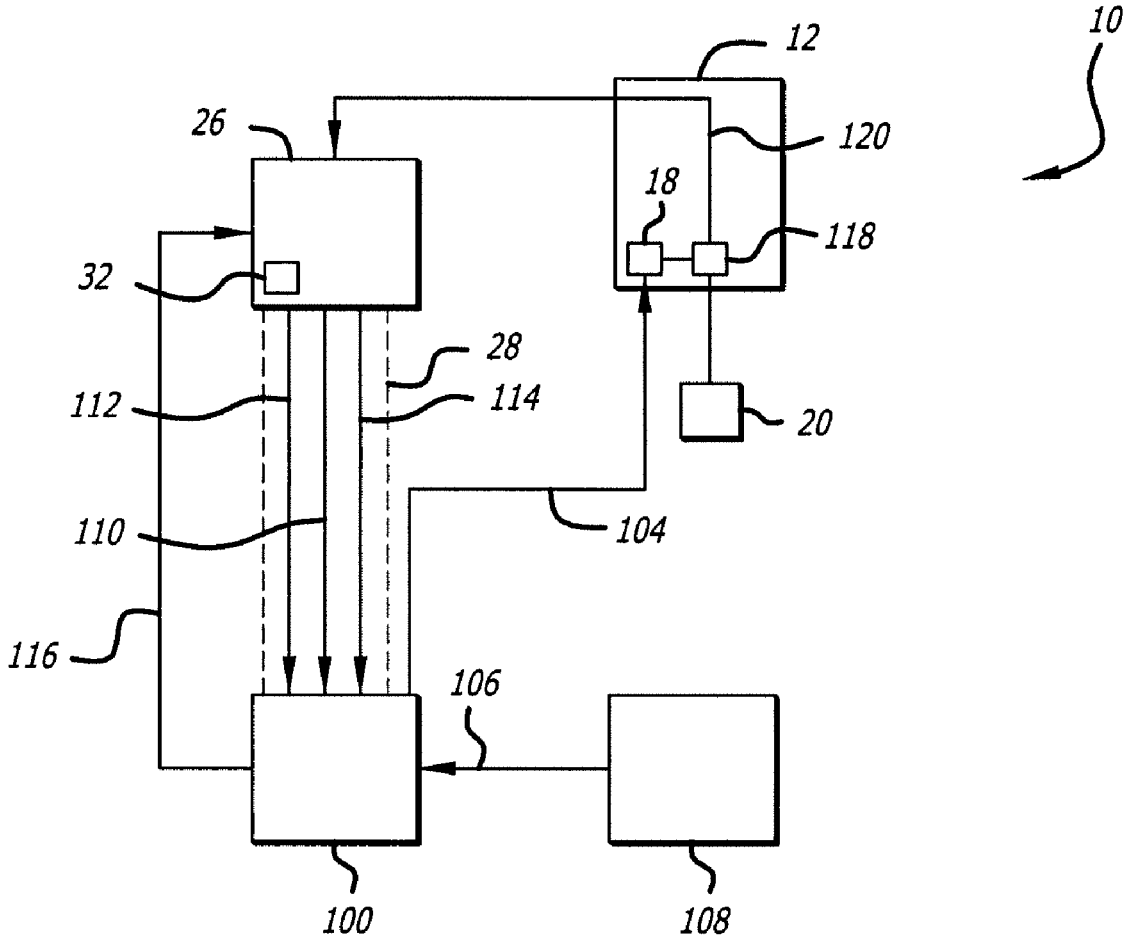
FIG. 3 is a block diagram of the horizontal drilling system in accordance with an exemplary embodiment of the present invention.

FIG. 3 is a block diagram of the horizontal drilling system 10 in accordance with an exemplary embodiment of the present invention. In such an embodiment, the horizontal drilling system 10 includes the top drive system 12 and the controller 26 as previously described. In addition, the horizontal drilling system 10 may include a motor controller 100 operatively connected to the top drive motor 18, which in one embodiment is an electric motor.

In one such embodiment, using a DC motor, the motor controller 100 receives high voltage/high current AC power 106 from an AC power supply 108, and transfers the AC power into regulated and controlled DC power for the electric motor 18. The electric motor 18, in turn, receives the DC power and supplies a torque to the top drive system 12, which in turn, is transferred to the drill string 20.

The motor controller 100 controls the speed of the electric motor 18 by controlling the voltage applied to the electric motor 18, and regulates the amount of torque that can be applied by the electric motor 18 by regulating the amount of current supplied to the electric motor 18. Although only a DC motor is described above an AC motor could also be used. In such an embodiment, the controller would regulate the torque and speed of the AC motor by regulating the frequency of the power supplied to the AC motor.

In one embodiment, the command signals 28 as described above include a directional command signal 110, a torque limit signal 112 and a speed command signal 114. In this embodiment, the motor controller 100 receives the directional command signal 110 transmitted by the controller 26 and responds to the directional command signal 110 by setting the direction of rotation of the electric motor 18. The electrical motor 18 may also have a directional switch 104 for reversing the direction of rotation of the electrical motor 18.

In this way, the controller 26 of this embodiment may control the rotational direction of the drill string 20 by generating a directional command signal 110 and transmitting the directional command signal 110 to the motor controller 100.

In such an embodiment, the motor controller 100 may also receive the torque limit signal 112 transmitted by the controller 26. The motor controller 100 of this embodiment uses the torque limit signal 112 to regulate the maximum amount of current supplied to the electric motor 18. Since the maximum amount of current supplied to the electric motor 18 determines the maximum amount of torque that can be applied by the electric motor 18 to the drill string 20, the controller 26 limits the amount of torque that can be applied by the electric motor 18 to the drill string 20.

The motor controller 100 may also receive the speed command signal 114 transmitted by the system controller 26. The motor controller 100 of such an embodiment uses the speed command signal 114 to regulate the voltage/frequency supplied to the electric motor 18. Since the rotational speed of the electric motor 18 is determined by the voltage/frequency supplied to the electric motor 18, the controller 26 determines the rotational speed that the electric motor 18 imparts of the drill string 20. In one embodiment, the motor controller 100 may also include a Silicon Controlled Rectifier (SCR) independently regulating the current and voltage (or frequency) supplied to the electric motor 18.

In one embodiment, the feedback signals 30 as described above include a torque feedback signal 116. In this embodiment, the motor controller 100 generates the torque feedback signal 116 and transmits the signal to the system controller 26. The torque feedback signal 116 is proportional to the electrical current flowing through the electric motor 18 and is thus proportional to the torque applied by the electric motor 18. The controller 26 uses the torque feedback signal 116 to monitor the amount of torque applied to the drill string 20 by the electric motor 18.

In one embodiment, the electric motor 18 may also be mechanically coupled to a turn encoder 118. In such an embodiment the turn encoder 118 monitors the amount of rotation of the electric motor 18, and sends a rotational feedback signal 120 to the controller 26 when the electric motor 18 has ceased to rotate, or has "stalled."

In one embodiment, an operator inputs operational parameters into a control station (not shown) to set the programming instructions 32 of the controller 26. For example, the operator may input specific operating parameters for the controller 26 to follow during an oscillation procedure, such as a torque limit for both the clockwise and counter-clockwise directions; and/or a rotation speed for both the clockwise and counter-clockwise directions. The torque limit may be the same in both the clockwise and counter-clockwise directions, or the torque limit may be different in the two directions.

With these parameters inputted, an oscillation procedure may be initiated. When the oscillation procedure is initiated, the controller 26 transmits command signals 28 to the top drive system 12 to initiate a rotation of the drill string 20 in an initial direction, for example the clockwise direction. During the rotation, the motor controller 100 monitors the torque applied to the drill string 20 and generates torque feedback signals 116 that are transmitted to the controller 26; and the turn encoder 118 monitors the amount of rotation of the drill string 20 and generates rotational feedback signals 120 that are transmitted to the controller 26.

When either the torque feedback signal 116 transmits a signal signifying that the torque limit for the clockwise direction has been exceeded; or the rotational feedback signal 120 transmits a signal signifying that drill string 20 has ceased to rotate (i.e., the motor 18 has stalled), the direction of rotation of the drill string 20 is reversed to the counter-clockwise direction.

As with rotation in the clockwise direction, the controller 26 transmits command signals 28 to the top drive system 12 to initiate a rotation of the drill string 20 in the counter-clockwise direction. During rotation in the counter-clockwise direction, the motor controller 100 monitors the torque applied to the drill string 20 and generates torque feedback signals 116 that are transmitted to the controller 26; and the turn encoder 118 monitors the amount of rotation of the drill string 20 and generates rotational feedback signals 120 that are transmitted to the controller 26. When either the torque feedback signal 116 transmits a signal signifying that the torque limit for the counter-clockwise direction has been exceeded; or the rotational feedback signal 120 transmits a signal signifying that drill string 20 has ceased to rotate, the direction of rotation of the drill string 20 is reversed back to the clockwise direction. This process may be repeated indefinitely.

Figure 4:
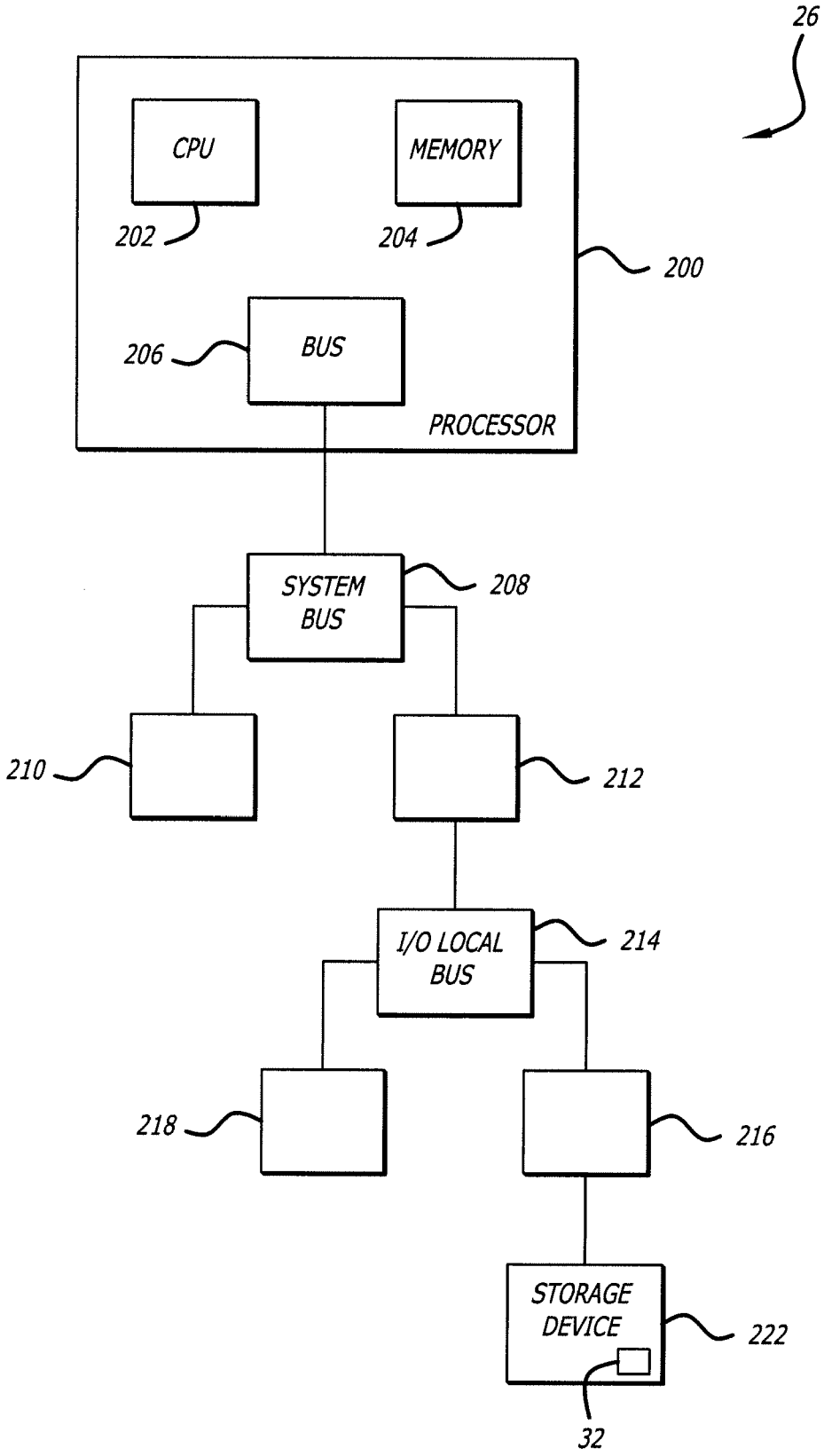
FIG. 4 is a block diagram of a controller in accordance with an exemplary embodiment of the present invention.

FIG. 4 is a block diagram for the controller 26 in accordance with one embodiment of the present invention. In this embodiment, the controller 26 includes a processor 200, having a central processing unit (CPU) 202, a memory cache 204, and a bus interface 206. The bus interface 206 is operatively coupled via a system bus 208 to a main memory 210 and an input/output (I/O) interface control unit 212. The I/O interface control unit 212 is operatively coupled via I/O local bus 214 to a storage controller 216, and an I/O interface 218 for transmission and reception of signals to external devices. The storage controller 216 is operatively coupled to a storage device 22 for storage of the programming instructions 32.

In operation, the processor 200 retrieves the programming instructions 32 and stores them in the main memory 210. The processor 200 then executes the programming instructions 32 stored in the main memory 210. The processor 200 uses the programming instructions 32 to generate the previously described command signals 28 and transmits the command signals 28 via the external I/O device 218 to the top drive system 12. The top drive system 12 responds to the command signals 28 and generates the previously described feedback signals 30 that are transmitted back to the controller 26. The processor 200 receives the feedback signals 30 via the external I/O device 218. The processor 200 uses the feedback signals 30 and the programming instructions 32 to generate additional command signals, command signals 110, 112, and 114, for transmission to the top drive system 12 as previously described.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. A horizontal drilling system comprising:

a top drive system comprising a motor that transmits a torque to a drill string to rotate the drill string;

an automated controller operably connected to the top drive, the automated controller being designed to communicate at least one directional command signal to the top drive to initiate the direction of the rotation of the drill string;

wherein the top drive generates at least one of a torque feedback signal indicating that a torque limit on the drill string is exceeded and a turn feedback signal indicating that the drill string is stalled;

wherein the controller receives the at least one feedback signal and reverses the direction of the torque applied to the drill string when either the torque limit is exceeded or the drill string stall; and wherein the automated controller is further designed to communicate at least one speed command signal and one torque limit signal to the top drive to control the speed of the motor and the torque applied by the motor.

2. The horizontal drilling system of claim 1, wherein the motor is a DC motor and wherein the automated controller is operably connected to a power supply such that the automated controller controls the speed of the electric motor by adjusting the voltage applied to the DC motor, and regulates the torque that can be applied by the DC motor by regulating the current supplied to the DC motor.

3. The horizontal drilling system of claim 2, wherein a motor controller generates the torque feedback signal by monitoring the current being supplied to the DC motor.

4. The horizontal drilling system of claim 1, wherein the motor is an AC motor and wherein the automated controller is operably connected to a power supply such that the automated controller controls the speed and torque of the AC motor by regulating the frequency of the power supplied to the AC motor.

5. The horizontal drilling system of claim 4, wherein a motor controller generates the torque feedback signal by monitoring the frequency of the power being supplied to the AC motor.

6. The horizontal drilling system of claim 1, further comprising a turn encoder operatively connected to the top drive, the turn encoder designed to monitor the rotation of the top drive and generate the turn feedback signal.

7. The horizontal drilling system of claim 1, further comprising a control station operatively connected to the automated controller and being designed to program the automated controller with the torque limit and the drill string stall limit information.

8. The horizontal drilling system of claim 1, wherein the automated controller further comprises:

a processor having a central processing unit;

a memory cache in signal communication with the processor;

a bus interface in signal communication with the processor and the top drive; and wherein the processor retrieves the at least one command signal from the memory cache and transmits the command signal through the bus interface to the top drive, and wherein the top drive generates the torque and turn feedback signals and transmits the feedback signals through the bus interface to the processor which operates on the feedback signals to generate additional command signals in a continuous feedback process.

9. The horizontal drilling system of claim 1, wherein the automated controller further comprises a set of programming instructions that direct the automated controller to repeat the reversal of direction of the torque applied to the drill string each time either the torque limit is exceeded or the drill string stalls.

10. A process for controlling a horizontal drilling operation comprising:

commanding a top drive system comprising a motor to transmit a torque to a drill string to rotate the drill string in a particular direction;

generating at least one of a torque feedback signal indicating that a torque limit on the drill string is exceeded and a turn feedback signal indicating that the drill string is stalled;

communicating the at least one feedback signal to an automated controller operably connected to the top drive, such that the automated controller outputs at least one directional command signal to the top drive to reverse the direction of the torque applied to the drill string when either the torque limit is exceeded or the drill string stalls; and communicating at least one speed command signal and one torque limit signal to the top drive to control the speed of the motor and the torque applied by the motor.

11. The process of claim 10, wherein the motor is a DC motor and wherein the process further comprises controlling the speed of the electric motor by adjusting the voltage applied to the DC motor, and regulating the torque that can be applied by the DC motor by regulating the current supplied to the DC motor.

12. The process of claim 11, further comprising generating the torque feedback signal by monitoring the current being supplied to the DC motor.

13. The process of claim 10, wherein the motor is an AC motor and wherein the process further comprises controlling the speed and torque of the AC motor by regulating the frequency of the power supplied to the AC motor.

14. The process of claim 13, further comprising generating the torque feedback signal by monitoring the frequency of the power being supplied to the AC motor.

15. The process of claim 10, further comprising monitoring the rotation of the top drive and generating the turn feedback signal.

16. The process of claim 10, further comprising pre-programming the automated controller with the torque limit and the drill string stall limit information.

17. The process of claim 10, further comprising:

retrieving at least one command signal from a memory cache;

transmitting the command signal to the top drive;

transmitting the feedback signals to the automated controller; and operating on the feedback signals to generate additional command signals in a continuous feedback process.

18. The process of claim 10, further comprising repeating the commanding of the top drive, generating the at least one feedback signal, communicating the feedback signal to the automated controller, and reversing the direction of the torque applied to the drill string to oscillate the drill string.

* * * * *